US011410839B2

(12) United States Patent
Jurek et al.

(10) Patent No.: US 11,410,839 B2
(45) Date of Patent: Aug. 9, 2022

(54) ELECTRON MULTIPLIERS INTERNAL REGIONS

(71) Applicant: ADAPTAS SOLUTIONS PTY LTD, Clyde (AU)

(72) Inventors: Russell Jurek, Clyde (AU); Kevin Hunter, Clyde (AU)

(73) Assignee: ADAPTAS SOLUTIONS PTY LTD, Clyde (AU)

( * ) Notice: Subject to any disclaimer, the term of this patent is extended or adjusted under 35 U.S.C. 154(b) by 0 days.

(21) Appl. No.: 17/282,472

(22) PCT Filed: Aug. 26, 2019

(86) PCT No.: PCT/AU2019/050899

§ 371 (c)(1),
(2) Date: Apr. 2, 2021

(87) PCT Pub. No.: WO2020/069557

PCT Pub. Date: Apr. 9, 2020

(65) Prior Publication Data

US 2021/0384018 A1 Dec. 9, 2021

(30) Foreign Application Priority Data

Oct. 5, 2018 (AU) ..... 2018903770

(51) Int. Cl.
*H01J 43/28* (2006.01)
*H01J 43/10* (2006.01)
*H01J 43/18* (2006.01)

(52) U.S. Cl.
CPC ..... *H01J 43/28* (2013.01); *H01J 43/10* (2013.01); *H01J 43/18* (2013.01)

(58) Field of Classification Search
None
See application file for complete search history.

(56) References Cited

U.S. PATENT DOCUMENTS 4,001,620 A 1/1977 Endriz
4,115,719 A 9/1978 Catanese et al.
(Continued)

FOREIGN PATENT DOCUMENTS

EP 1939917 B1 2/2015

OTHER PUBLICATIONS

International Search Report dated Sep. 23, 2019 for corresponding PCT/AU2019/050899 filed on Aug. 26, 2019.
(Continued)

*Primary Examiner* — Ashok Patel
(74) *Attorney, Agent, or Firm* — David D. Brush; Westman, Champlin & Koehler, P.A.

(57) ABSTRACT

An electron multiplier apparatus of the type used in ion detectors, and modifications thereto for extending the operational lifetime or otherwise improving performance. The electron multiplier includes a series of discrete electron emissive surfaces configured to provide an electron amplification chain, the electron multiplier being configured so as to inhibit or prevent a contaminant from entering into, or passing partially through, or passing completely through the electron multiplier. The electron multiplier may include one or more baffles configured so as to decrease vacuum conductance of the electron multiplier compared to the same or similar electron multiplier not having one or more baffles.

25 Claims, 11 Drawing Sheets

(56) References Cited

U.S. PATENT DOCUMENTS

| | | | | |
|---|---|---|---|---|
| 6,617,768 | B1 | 9/2003 | Hansen | |
| 7,023,134 | B2 | 4/2006 | Shimoi et al. | |
| 2010/0096985 | A1* | 4/2010 | Watase ..... | H01J 43/00 313/533 |
| 2011/0095174 | A1 | 4/2011 | Suyama et al. | |
| 2016/0379809 | A1 | 12/2016 | Badiei et al. | |
| 2017/0047213 | A1 | 2/2017 | Hayashi | |

OTHER PUBLICATIONS

Written Opinion dated Sep. 23, 2019 for corresponding PCT/AU2019/050899 filed on Aug. 26, 2019.

* cited by examiner

ELECTRON MULTIPLIERS INTERNAL REGIONS

The present application is a Section 371 National Stage Application of International Application No. PCT/AU2019/050899, filed Aug. 26, 2019 and published as WO 2020/069557 A1 on Apr. 9, 2020, in English, which claims priority from Australian provisional patent application 2018903770, filed Oct. 5, 2018, the contents of which are hereby incorporated by reference in their entireties.

FIELD OF THE INVENTION

The present invention relates generally to components of scientific analytical equipment. More particularly, the invention relates to electron multiplier apparatus of the type used in ion detectors, and modifications thereto for extending the operational lifetime or otherwise improving performance.

BACKGROUND TO THE INVENTION

In a mass spectrometer, the analyte is ionized to form a range of charged particles (ions). The resultant ions are then separated according to their mass-to-charge ratio, typically by acceleration and exposure to an electric or magnetic field. The separated signal ions impact on an ion detector surface to generate one or more secondary electrons. Results are displayed as a spectrum of the relative abundance of detected ions as a function of the mass-to-charge ratio.

In other applications the particle to be detected may not be an ion, and may be a neutral atom, a neutral molecule, or an electron. In any event, a detector surface is still provided upon which the particles impact.

The secondary electrons resulting from the impact of an input particle on the impact surface of a detector are typically amplified by an electron multiplier. Electron multipliers generally operate by way of secondary electron emission whereby the impact of a single or multiple particles on the multiplier impact surface causes single or (preferably) multiple electrons associated with atoms of the impact surface to be released.

One type of electron multiplier is known as a discrete-dynode electron multiplier. Such multipliers include a series of surfaces called dynodes, with each dynode in the series set to increasingly more positive voltage. Each dynode is capable of emitting one or more electrons upon impact from secondary electrons emitted from previous dynodes, thereby amplifying the input signal.

In a detector, the amplified electron signal impacts on a terminal anode which outputs an electrical signal proportional to the number of electrons which impact it. The signal from the anode is conveyed to a computer for analysis as is well understood in the art.

It is a problem in the art that the performance of electron emission-based detectors degrade over time. It is thought that secondary electron emission reduces over time causing the gain of the electron multiplier to decrease. To compensate for this process, the operating voltage applied to the multiplier must be periodically increased to maintain the required multiplier gain. Ultimately, however, the multiplier will require replacement. It is noted that detector gain may be negatively affected both acutely and chronically.

Prior artisans have addressed the problems of dynode ageing by increasing dynode surface area. The increase in surface area acts to distribute the work-load of the electron multiplication process over a larger area, effectively slowing the aging process and improving operating life and gain stability. This approach provides only modest increases in service life, and of course is limited by the size constraints of the detector unit with a mass spectrometry instrument.

A further problem in the art of electron multiplication is that of ion feedback. Ion feedback is the process by which neutral particles (such as residual gas molecules) within or about an electron multiplier become ionized. The neutral particles may be ionized by any individual high energy electron. Such ionization is more likely to occur in regions of higher electron flux, and is typically proportional to the electron flux for a fixed background of neutral particles. Accordingly, while ionization may occur at any point within the electron multiplier, most occurs toward the output end of the electron amplification chain near the collector. Ionization of neutral species also occurs outside the detector. Discrete dynode detectors are typically quite 'open' to the local environment. As the dynode-to-dynode electron transfer efficiency is less than 100%, some secondary electrons escape to the local environment and migrate into the external environment of the vacuum chamber where they ionize neutral gas particles However formed, the ions (being positively charged) are attracted towards the input end of the multiplier (including ions formed external the multiplier) due to the voltage potential applied to the device. If these ions acquire sufficient energy, secondary electrons will result upon collision with an electron emissive surface within the multiplier. The ion induced secondary emissions in turn cascade and multiply, leading to spurious output pulses which degrade the performance of the device.

The spurious pulses may manifest as background noise, baseline structure, spurious peaks or a combination thereof. Suppressing ion feedback is an important aim in the design of an electron multiplier because of the myriad ways that it can manifest and affect detector performance.

Two methods have been proposed for reducing ion feedback in prior art electron multiplier. A first approach is that of ion blocking or trapping, with a second approach being prevention of ion formation. In the first approach the probability of an ion gaining sufficient energy or momentum to cause spurious pulse is reduced by physical or electrical alteration of the channel. In general, ion trapping or blocking does not remove the source of ion feedback, namely the ions themselves.

As one practical example of the first approach, ion feedback has been suppressed in prior art multipliers by the use of 'blocking' dynodes that limit the extent of electron multiplication. Blocking dynodes function to suppress the initial impact energy of feedback ions when they strike a dynode. Typically, a blocking dynode is configured to limit the line-of-sight between two or more sequential blocking dynodes.

Reference is made to FIG. 1 which shows a typically arrangement of three dynodes in an electron amplification chain. The amplification process starts with the emission of secondary electrons from dynode A due to ion/electron impact. These emitted electrons are drawn towards the extended section of dynode B (being the uppermost section). The short section (being the lowermost section) of the emitting dynode A, simultaneously shields these electrons from the effect of the extended section of the adjacent dynode, C, which is at a higher voltage than the target dynode, B. The extended section of C extends sufficiently far such that the short section of dynode A no longer blocks its influence on the electron trajectories. At this point, the electrons are pulled down towards dynode C, which focuses the electrons onto the medium (central) and short sections of the target dynode, B. These electrons then trigger a repeat of this process, with dynode B becoming the new dynode A.

The coupling of adjacent extended and short sections in this process has resulted in a generic dynode shape and arrangement in prior art electron multiplier which is representative of the state of the art. While generally effective, an undesirable outcome of such configuration is an increase in ion feedback, as higher efficiency dynode-to-dynode electron transfers typically increase the extent of the detector's central gap.

It is an aspect of the present invention to provide an improved electron multipliers having an extend service life and/or improvement in performance. It is a further aspect of the prior art to provide a useful alternative to prior art electron multipliers.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention as it existed before the priority date of each claim of this application.

SUMMARY OF THE INVENTION

In a first aspect, but not necessarily the broadest aspect, the present invention provides an electron multiplier comprising a series of discrete electron emissive surfaces configured to provide an electron amplification chain, the electron multiplier being configured so as to inhibit or prevent a contaminant (including but not limited to a contaminant traveling in a sample carrier gas stream) from entering into, or passing partially through, or passing completely through the electron multiplier.

In one embodiment of the first aspect, the electron multiplier comprises one or more baffles configured so as to prevent or inhibit a contaminant from entering into, or passing partially through, or passing completely through the electron multiplier.

In one embodiment of the first aspect, the one or more baffles are configured so as to decrease vacuum conductance of the electron multiplier compared to the same or similar electron multiplier not having one or more baffles.

In one embodiment of the first aspect, a linear path is defined within the electron multiplier, the linear path allowing for a contaminant to enter into, or pass partially through, or pass completely through the electron multiplier but for the presence of the one or more baffles.

In one embodiment of the first aspect, the series of discrete electron emissive surfaces are disposed about a central axis of the electron multiplier, and wherein the one or more baffles approach, abut or intersect with the central axis.

In one embodiment of the first aspect, the series of discrete electron emissive surfaces are disposed about a central axial region of the electron multiplier, and wherein the one or more baffles extend into the central axial region.

In one embodiment of the first aspect, the one or more baffles completely traverse the central axial region.

In one embodiment of the first aspect, the one or more baffles extend from a housing of the electron multiplier, or from an existing structure within the electron multiplier, or from a dedicated structure within the electron multiplier.

In one embodiment of the first aspect, each of the series of discrete electron emissive surfaces is or is a part of a dynode, and one of the one or more baffles extends from the dynode.

In one embodiment of the first aspect, the dynode has a peripheral region and the one or more baffles extend from the peripheral region.

In one embodiment of the first aspect, the dynode has, in cross-section, a first section and a third section each of which extend generally toward a central axis or central region of the electron multiplier, the first and third section being joined by a second section, and wherein (i) the baffle extends from the first section or the third section, or (ii) the first section or the third section are extended so as to function in least in part as a baffle.

In one embodiment of the first aspect, the first section is, in cross-section, longer than the third section.

In one embodiment of the first aspect, the second section has a length, in cross-section that is intermediate to the length of the first section and the second section.

In one embodiment of the first aspect, the dynode is fabricated from a single piece of material, and the first and third sections of the dynode are each defined by a bend at the respective interface with the second section, and wherein the first and third sections extend generally toward a central axis or a central region of the electron multiplier.

In one embodiment of the first aspect, each of the series of discrete electron emissive surfaces is a dynode, the series of dynodes being arranged in an interleaving manner.

In one embodiment of the first aspect, the first section of a dynode interleaves with the first section of the next dynode in the amplification chain.

In one embodiment of the first aspect, the first section of the dynode is the section most proximal to electron multiplier input.

In one embodiment of the first aspect, the first section of a dynode interleaves with the first section of the next dynode in the amplification chain so as to provide overlapping between the first and second sections of at least about 0.1 mm, 0.2 mm, 0.3 mm, 0.4 m, 0.5 mm, 0.6 mm, 0.7 mm, 0.8 mm, 0.9 mm, 1.0 mm, 1.1 mm, 1.2 mm, 1.3 mm, 1.4 mm, 1.5 mm, 1.6 mm, 1.7 mm, 1.8 mm, 1.9 mm, or 2.0 mm.

In one embodiment of the first aspect, the electron multiplier comprises at least about 2, 3, 4, 5, 6, 7, 8, 9, 10, 11, 12, 13, 14, 15, 16, 17, 18, 19 or 20 baffles.

In one embodiment of the first aspect, at least one of the dynodes is configured or positioned to function as baffle.

In one embodiment of the first aspect, at least one of the one or more baffles each extend for a distance of about 0.1 mm, 0.2 mm, 0.3 mm, 0.4 m, 0.5 mm, 0.6 mm, 0.7 mm, 0.8 mm, 0.9 mm, 1.0 mm, 1.1 mm, 1.2 mm, 1.3 mm, 1.4 mm, 1.5 mm, 1.6 mm, 1.7 mm, 1.8 mm, 1.9 mm, or 2.0 mm.

In a second aspect, the present invention provides a particle detector comprising the electron multiplier of any embodiment of the first aspect, and a collector configured to collect secondary electrons output by the electron multiplier.

DETAILED DESCRIPTION OF THE INVENTION AND ILLUSTRATIVE EMBODIMENTS THEREOF

Figure 1:
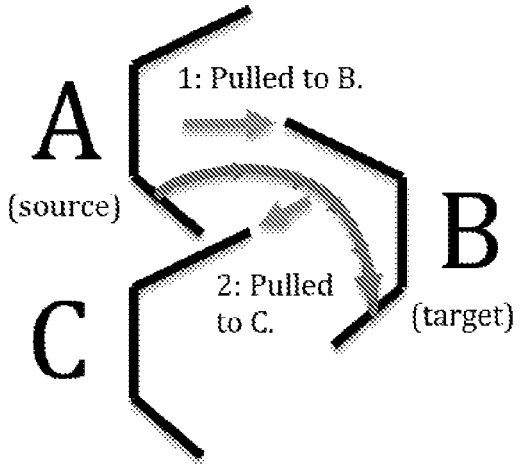
FIG. 1 (PRIOR ART)
FIG. 1 is a highly schematic diagram showing the direction movement of secondary electrons in an electron multiplier comprising prior art dynodes.

After considering this description it will be apparent to one skilled in the art how the invention is implemented in various alternative embodiments and alternative applications. However, although various embodiments of the present invention will be described herein, it is understood that these embodiments are presented by way of example only, and not limitation. As such, this description of various alternative embodiments should not be construed to limit the scope or breadth of the present invention. Furthermore, statements of advantages or other aspects apply to specific exemplary embodiments, and not necessarily to all embodiments covered by the claims.

Throughout the description and the claims of this specification the word "comprise" and variations of the word, such as "comprising" and "comprises" is not intended to exclude other additives, components, integers or steps.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may.

It will be appreciated that not all embodiments of the invention described herein have all of the advantages disclosed herein. Some embodiments may have a single advantage, while other may have no advantage at all and are merely a useful alternative to the prior art.

The present invention is predicated at least in part on the inventors' discovery that improvements in prior art electron multipliers are realised where the vacuum conductance of an electron multiplier is reduced. This reduction in conductance may be achieved by preventing or inhibiting entry of contaminant species (such as residual gas molecules originating from a carrier gas stream). In addition or alternatively, the reduction in conductance may be achieved by preventing or inhibiting contaminant species from moving through the electron multiplier. In the latter circumstance, a containment species may be allowed to enter the internal space of the electron multiplier, but the multiplier is configured so as limit the ability of the contaminant to penetrate deeply into the multiplier internal space. In some circumstances, the contaminant species is prevented from penetrating to areas around the dynodes located in the mid region or even the terminal region of electron multiplication chain. In some circumstances, the contaminant species is prevented from penetrating to areas around the collector surface that (being anodic) receives secondary electrons emitted from the terminal dynode.

In some embodiments of the invention the electron multiplier comprises one or more physical barriers disposed within the internal space. The term "baffle" is used herein to refer to such a physical barrier.

Where the electron multiplier comprises baffles, the baffles are typically positioned and/or sized and/or shaped so as to be considered "internal" the multiplier. In this context, the term "internal" is intended to refer to the circumstance whereby at least some part of the baffle, or all of the baffle, is within the bounding volume of the electron multiplier. In some embodiments, part or all of a baffle extends into a space that exists between two opposing dynodes, such as two sequential dynodes of an electron amplification chain.

In many circumstances, an electron multiplier will be embodied in the form of an ion detector (by the inclusion of a collector/anode) and in which case the term "internal" may be defined to mean internal to the bounding volume of the detector.

It will be generally desirable for any baffle to be sized, dimensioned or positioned so as to allow for any electron multiplier or ion detector comprising the baffle to functionally engage with an instrument (such as a mass spectrometer) without any need for modification of the instrument. Thus, a baffle that would prevent installation of the electron multiplier or ion detector is to be generally avoided.

A decrease in the level of contaminant species in the electron multiplier may address the problem of ion feedback. Given that contaminant species may be ionized (and therefore a source of feedback ions) the baffles may decrease levels of ion feedback in an electron multiplier. As will be understood, ionization in a multiplier occurs to a greater extent toward the end of the electron multiplication chain (i.e. toward the collector anode) where electron flux is highest. Thus, embodiments of the invention that allow a contaminant species to enter the multiplier but nevertheless at least inhibit the passage of the contaminant to an end region of the device may nevertheless provide a substantial decrease in ion feedback.

With regard to the problem of shortened service life, the decrease in contaminant species within the multiplier may spare the electron emissive surfaces therein from fouling to at least some extent. The electron emissive surfaces (typically embodied in the form of dynodes) remain responsive to incoming electrons for a longer period thereby extending service life. Suppressing ion feedback may also indirectly extend detector life given that a detector can only output a certain amount of charge, and ion feedback wastes some of that charge.

An electron multiplier typically comprises a series of discrete electron emissive surfaces configured to provide an electron amplification chain. According to the invention, the electron multiplier may be configured so as to inhibit or prevent a contaminant traveling in a sample carrier gas stream from entering into, or passing partially through, or passing completely through the electron multiplier. In the design of prior art electron multipliers, there has been no recognition of the importance of vacuum conductance of the multiplier device itself.

As will be understood by the skilled person, an electron multiplier that functions as an ion detector in a mass spectrometer operates under conditions of high vacuum in a chamber, with a carrier gas used to introduce sample particles (such as ions) into the chamber. The sample particles are accelerated within the chamber and separated according to mass/charge ratio before entering an electron multiplier. It is the task of the electron multiplier to convert a single ion into an avalanche of secondary electrons by a series of electron emissive surfaces. The secondary electrons produced by the last of the emissive surfaces impact on a collector anode to form an electrical signal. Sample carrier gas also enters the chamber, and carries with it not only sample material but also contaminants. Thus, contaminants may be carried through the vacuum chamber to the electron multiplier so as to negatively impact on the operation of the multiplier.

Contaminants may arise from sources apart from carrier gas. Contaminants may enter the vacuum chamber from any of the various electronic feedthroughs and pump seals. For example, it is not uncommon for a diffusion pump to leak a trace amount of oil into the chamber.

All contaminants within the chamber will eventually make their way into the detector. It's a question of when, not if. The baffling limits the mobility of the contaminant once it has entered the detector.

Figure 2:
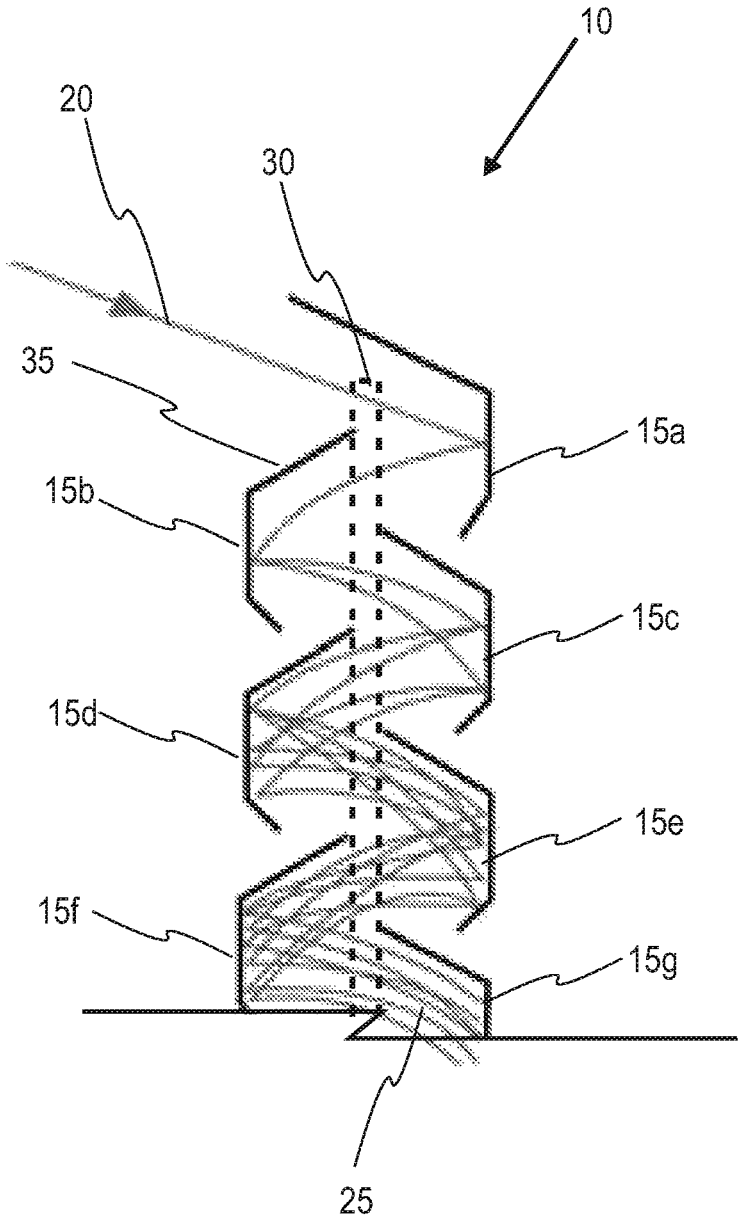
FIG. 2 (PRIOR ART)
FIG. 2 is a highly schematic diagram showing the generation of a secondary electron avalanche in a prior art electron multiplier. The bounds of the three-dimensional central linear space formed by the dynodes is shown as the dashed line rectangle.

In accordance with the present invention, the vacuum conductance of the electron multiplier is reduced so as prevent or at least inhibit passage of a contaminant into and/or through the multiplier so as to limit exposure of electron emissive surfaces and the general internal environment of the detector to a contaminant With an electron multiplier, a linear path is defined between opposing dynodes as shown in FIG. 2, being a highly diagrammatic representation of the dynodes of a prior art discrete dynode electron multiplier (10). This multiplier (10) operates on the same basis as described in the Background section herein, and in reference to FIG. 1. Each of the dynodes in the electron amplification chain are sequentially numbered (15*a* through 15*g*). The path of an incoming ion (20) is shown at the entry of the multiplier (10), with the subsequent amplification leading to an avalanche of electrons (25). As will be noted, a narrow linear space (30) runs along a central axis and internal the multiplier (10) as shown by the dashed rectangle. The linear space (30) is defined (at least in width) by the edges of the dynodes (15). Applicant proposes that the linear space (30) contributes to the overall vacuum conductance of the electron multiplier, and that in order to reduce conductance some means of preventing or limiting the passage of a gas through the linear space (30) is provided.

It will be noted in the prior art arrangement of FIG. 2, that each dynode (15) has an extended section (marked 35). Such dynodes are termed "blocking dynodes" in the prior art, because they are used to block the line of sight along the central linear space that runs through the detector. As discussed in the Background section herein, the aim of such limitation is to reduce ion feedback, an acknowledged problem in the art. By the use of blocking dynodes it is possible to suppress the initial impact energy of an incoming ion, with the aim of limiting any electron multiplication. The extension (35) is just sufficiently long so as to prevent a line-of-sight through the detector between two or more sequential blocking dynodes. The functional cost of extending the long section to create a blocking dynodes is a reduction in the efficiency of the dynode-to-dynode electron transfer. For this reason, the overlap of the long sections of sequential dynodes is typically chosen to be close to zero (0.1 mm for example). After consideration of manufacturing tolerances this often results in nominal overlaps of about 0.2 mm, to guarantee a worst-case overlap of 0.1 mm.

Prior art electron multipliers often include one set of four blocking dynodes or two sets of three blocking dynodes. The limited use of blocking dynodes minimizes the overall efficiency loss, while substantially suppressing ion feedback. Typically, more than two blocking dynodes are used in a set to account for manufacturing tolerances. While the extended section could be extended further to account for manufacturing tolerances, however, the dynode-to-dynode electron transfer efficiency rapidly declines. Using three or four blocking dynodes in a single set therefore results in a greater overall efficiency, as compared with the use of a set of two blocking dynodes with even longer extended sections.

According to the present invention, a prior art electron multiplier is modified so as to limit the opportunity for a gas to flow through the linear space (30). Such limitation may be achieved where the multiplier is designed so as to provide a non-linear or tortuous path to limit or prevent the ability for a gas to pass into or through the multiplier, the end result being a reduction in vacuum conductance of the multiplier.

Figure 3:
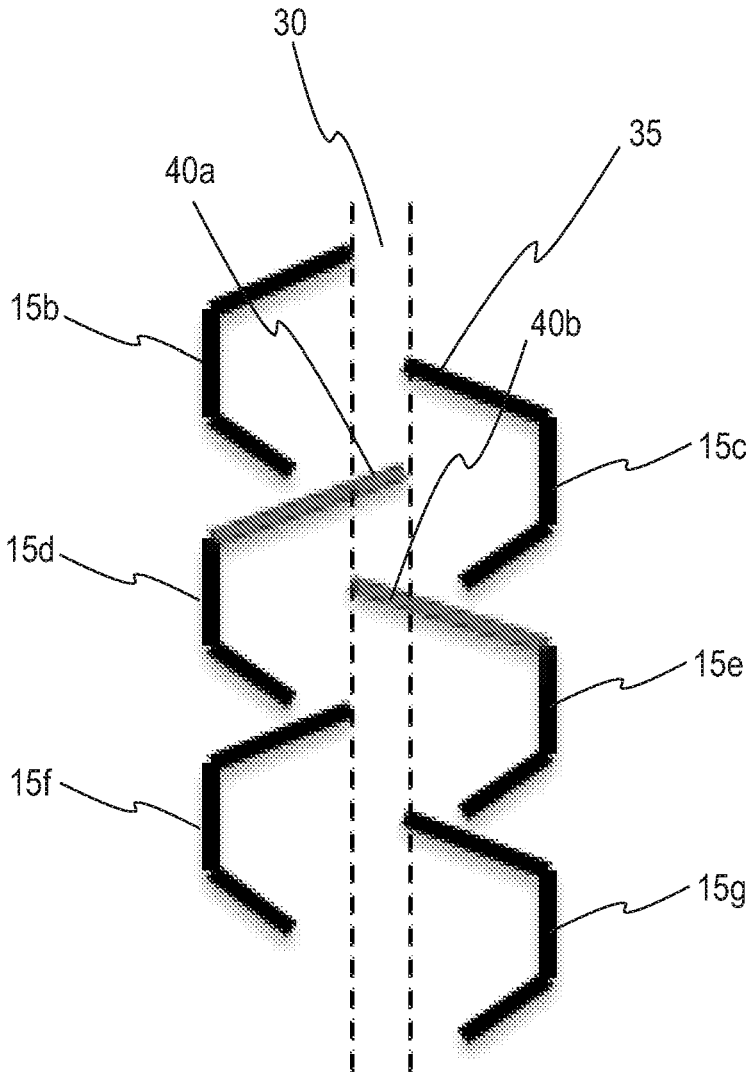
FIG. 3 is a highly schematic diagram showing a proportion of dynodes of an electron multiplier. Two of the dynodes which are sequential in the electron amplification chain are modified such that the upper sections are hyper-extended so as to (i) overlap with each other and (ii) extend into the central linear space of the multiplier.

Considering now various arrangements of physical baffles disposed within the present electron multiplier, reference is made to FIG. 3 which shows an embodiment of the invention whereby the baffles are provided by extending the upper sections of each dynode so as to overlap within the central linear space (30) within the electron multiplier. In the embodiment of FIG. 3, the dynodes (15*d*) and (15*e*) have hyper-extended sections (40*a*) and (40*b*) respectively. The hyper-extended sections (40*a*) and (40*b*) are each longer than the extended sections (one marked 35) such that the termini extend into the central linear space (30). Moreover, the hyper-extended sections (40*a*) and (40*b*) are present on dynodes (15*d*) and (15*e*) which are sequential in the electron amplification chain, and overlap across the linear space (30). As will be appreciated, the hyper-extended sections (40*a*) and (40*b*) present a tortuosity in the linear space (30) thereby negatively affecting the vacuum conductance of the electron multiplier. In turn, contaminants are less likely to enter the space (30). Even if a contaminant entered the space (30) and foul dynode (15*b*), a contaminant is less likely still to travel to dynode (15*d*) and still less likely to reach dynode (15*e*).

The hyper-extended section (40*a*) and (40*b*) do not provide an absolute barrier to the entry into or passage through the linear space (30). Instead, a general resistance to gas flow through the multiplier may be provided thereby lessening the opportunity for contaminant to enter the space (30) and even lessen the opportunity to enter regions of the space (30) above the first hyper-extended section (40*a*) of dynode (15*b*). In some circumstances contaminant may deposit on the rear (upwardly directed) face of a hyper-extended sections (40*a*) or (40*b*) thereby sparing fouling of the electron emissive surfaces of the dynodes.

The opportunity is taken to clarify that relative directional terms such as "upward", "downward" and the like are used for convenience only to identify various drawn features. When installed in an instrument (such as a mass spectrometer) the features may be oriented differently to a directional term used herein.

In the embodiment of FIG. 3, a pair of hyper-extended dynode sections of two sequential dynodes interleave. Some advantage may be gained where only a single baffle is provided by way of a single dynode comprises a hyper-extended section. Advantage over the embodiment of FIG. 3 may be gained where more than two baffles are provided, for example where a third, fourth, fifth, sixth, seventh, eighth, ninth, tenth, eleventh or twelfth baffle is provided, for example by way of a third, fourth, fifth, sixth, seventh, eighth, ninth, tenth, eleventh or twelfth dynode having a hyper-extended section.

To further reduce vacuum conductance, each dynode of an electron multiplier may have a hyper-extended section to provide as many baffles as possible. In one embodiment, a significant minority (for example, 35% or more) of sequential dynode pairs have hyper-extended baffle sections.

For embodiments of the invention comprising some dynodes that are devoid of a hyper-extended section, those dynodes which do have a hyper-extended section may be arranged so as to obtain useful reduction in vacuum conductance. For example, a block of dynodes acting as baffles may be disposed exist at the input side of the electron multiplier so as to limit the entry of gas into the detector. As a further example, a block of dynodes acting as internal baffles may be disposed at the output side of the multiplier, about the collector/anode so as to limit the entry of gas into the region of the detector with the highest electron flux. In a further arrangement, dynodes acting as internal baffles may be otherwise evenly spaced so as to minimize the extent of lines-of-sight through the multiplier.

The presence of one or more baffles in an electron multiplier may lead to some reduction in multiplication efficiency. Independent of the number or arrangement of dynodes acting as internal baffles are used, efficiency costs may be offset at least in part by the use of hyper-extended baffling sections of various sizes within a multiplier. The efficiency cost attributable to a baffle increases according to the size of the projected overlap with another baffle. By incorporating a range of baffle sizes within a detector, it may be possible to provide relatively high levels of baffling in certain regions of the detector, while providing relatively low levels in others. For example, the largest and most effective baffles may be used about the collector/anode at the end of the multiplication chain where most negative effects of contaminants are seen. Similarly, large baffles may be used at the multiplier entrance, where the majority of contaminants enter.

When arranged in the context of an electron multiplier, the baffles (such as the hyper-extended sections of two sequential dynodes in the amplification chain) may extend sufficiently so as to overlap to create an interleaving arrangement between the sequential dynodes. The overlap may be considered from an axial view of the multiplier, or reference to a plane perpendicular to the multiplier's principal axis.

In some embodiments, a minimum projected overlap of about 0.05 mm, 0.1 mm, 0.15 mm, 0.2 mm, 0.25 mm, 0.3 mm, 0.4 mm, 0.5 mm, 0.6 mm, 0.7 mm, 0.8 mm, 0.9 mm or 1 mm is provided. In some embodiments, the overlap is at about 0.25 mm.

Figure 4:
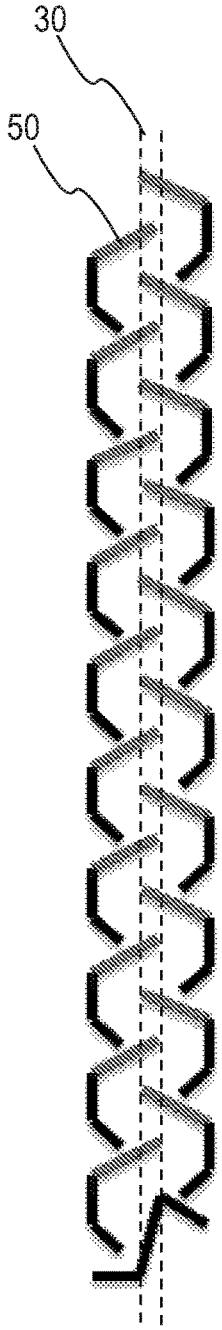
FIG. 4 through FIG. 10 each show a highly schematic diagram of dynodes of a complete electron multiplier. In each drawing, the input particle (typically an ion) enters at the top of the multiplier (as drawn), with the avalanche of secondary electrons generated by the dynodes exiting at the bottom. The various drawings exemplify embodiments having varying proportions of modified versus unmodified dynodes, and the positioning of modified dynodes in certain regions of the electron multiplier.

Further embodiments will now be described by reference to the drawings, with reference being made to FIG. 4 which shows an arrangement of all dynodes of an electron multiplier. In this embodiment, the multiplier has 20 dynodes. Each of the dynodes comprises a hyper-extended upper section (one marked 50), with all hyper-extended sections extending into the linear space (30). In addition to extending into the linear space (30), the hyper-extended sections overlap such that sequential dynodes interleave.

Figure 5:
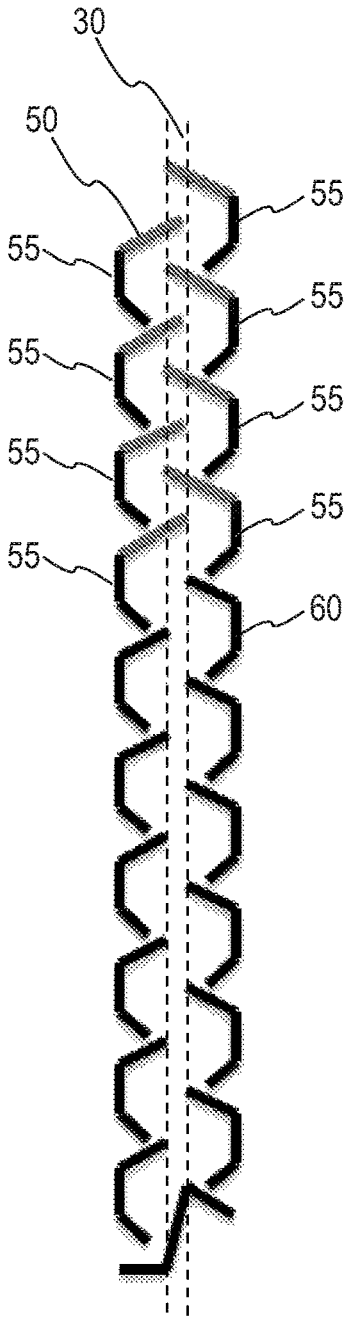

Reference is now made to FIG. 5, which shows an arrangement of 20 dynodes with the first 8 dynodes (55) comprising a hyper-extended upper section (one marked 50), with all hyper-extended sections extending into the linear space (30) and in overlapping arrangement. The ninth dynode (60) and onwards in the electron multiplication chain are prior art dynodes for which no section extends into the linear space (30). In this embodiment, the hyper-extended sections of the first 8 dynodes form a tortuosity in a space between the dynodes that would otherwise provide little if any resistance to gas flow therethrough. The resistance to gas flow provided by the first 8 dynodes reduces vacuum conductions of the multiplier overall. In particular, contaminant particles are prevented or inhibited from penetrating into the mid region of the multiplier (i.e. around the ninth dynode 60).

Figure 6:
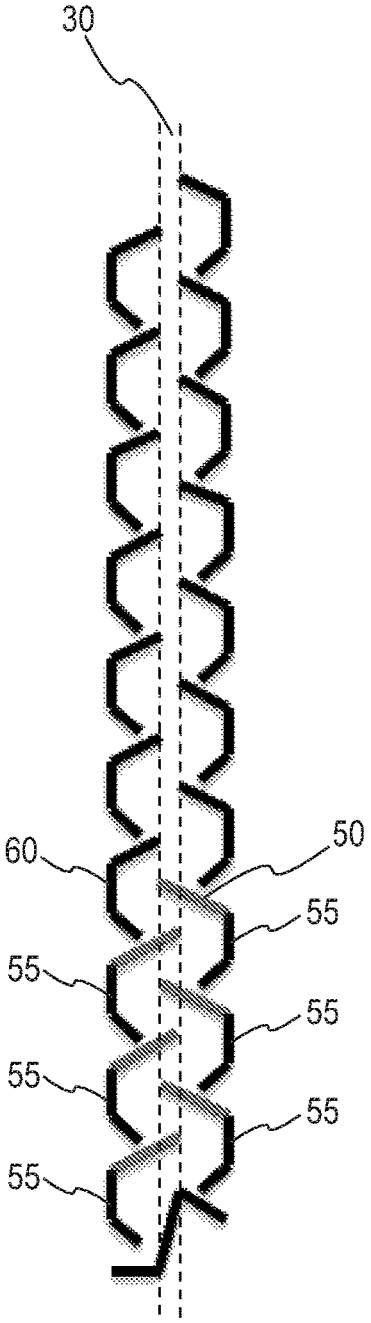

The embodiment of FIG. 6 shows an arrangement of 20 dynodes with the first 14 dynodes (the last of which is marked 60) are prior art dynodes that are devoid of any hyper-extended region. Accordingly, gas is relatively uninhibited in its travel through the linear region 30 until the gas encounters the fifteenth dynode which comprises a hyper-extended upper section (50), which extends into the linear space (30) and in overlapping arrangement with hyper-extended sections of the sixteenth to twentieth dynodes. In this embodiment, the hyper-extended sections of the final 6 dynodes form a tortuosity in a space between the dynodes that would otherwise provide little if any resistance to gas flow therethrough. The resistance to gas flow provided by the final 6 dynodes reduces vacuum conductions of the multiplier overall. In particular, contaminant particles are permitted to penetrate into the mid region of the multiplier, but prevented or inhibited from the final region about the anode/collector.

Figure 7:
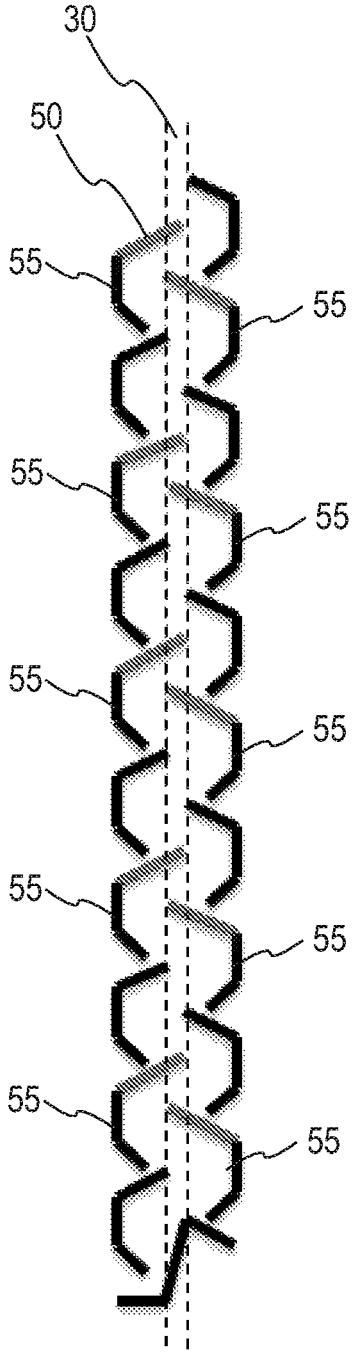

In the embodiment of FIG. 7, all dynodes having hyper-extended sections are marked (55) while prior art dynodes are unmarked. It will be noted that prior art dynodes and dynodes having hyper-extended sections alternate strictly. This arrangement provides a tortuosity for the entire length of the multiplier, although the tortuosity is less than that provided by a multiplier where all dynodes have hyper-extended sections (as shown in FIG. 4, for example).

Figure 8:
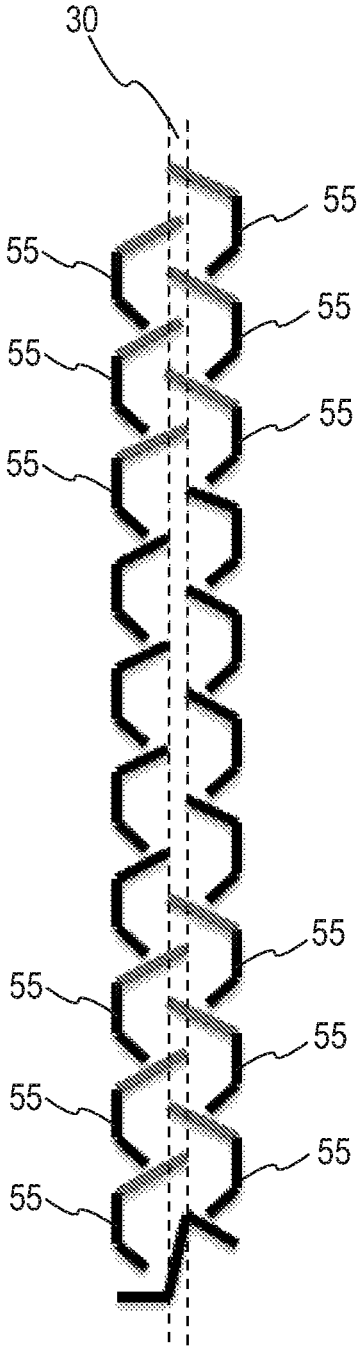

In the embodiment of FIG. 8, all dynodes having hyper-extended sections are marked (55) while prior art dynodes are unmarked. As will be noted, the passage of gas is restricted at both the input (top) and output (bottom) regions of the multiplier by way of the first 6 and final 6 dynodes comprising a hyper-extended section. The central region comprising 8 prior art dynodes does not occasion any loss of efficiency, although the first 6 and final 6 dynodes will impart an efficiency cost on the multiplier overall.

Figure 9:
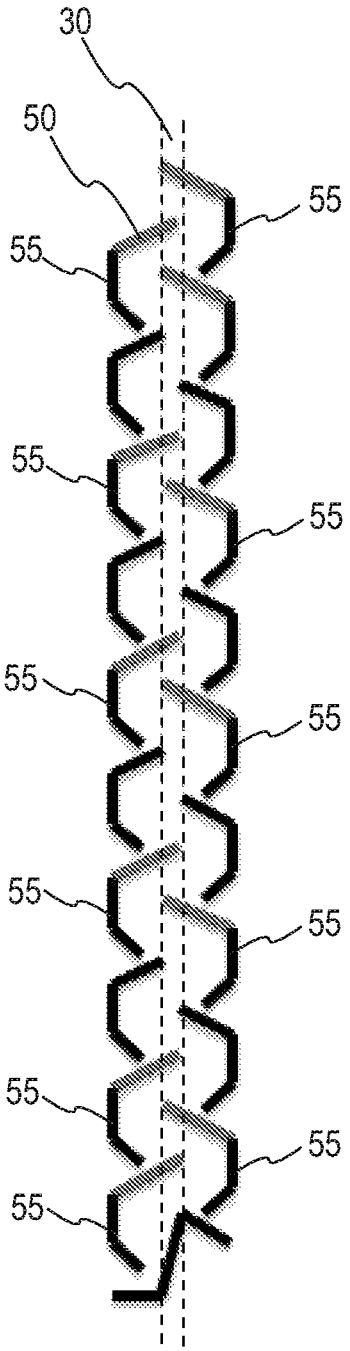

In the embodiment of FIG. 9, all dynodes having hyper-extended sections are marked (55) while prior art dynodes are unmarked. The first 3 and final 6 dynodes each form a block at the input and output regions of the multiplier. The remaining dynodes are formed into sequential pairs, with the first sequential pair (dynodes 4 and 5) being prior art dynodes, the second sequential pair (dynodes 6 and 7) being dynodes comprising hyperextended sections, the third sequential pair (dynodes 8 and 9) being prior art dynodes, the fourth sequential pair (dynodes 10 and 11) being dynodes comprising hyperextended sections, the fifth sequential pair (dynodes 12 and 13) being prior art dynodes, the sixth sequential pair (dynodes 14 and 15) being dynodes comprising hyperextended sections, and the seventh sequential pair (dynodes 12 and 13) being prior art dynodes.

Figure 10:
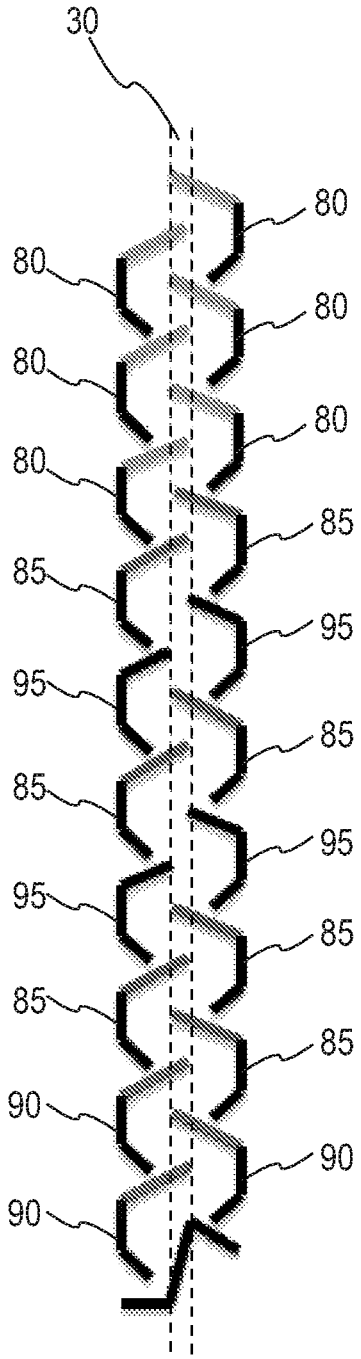

The embodiment of FIG. 10 use three types of dynode: Dynodes having a hyper-extended section which provides an overlap of about 0.25 mm when interleaved with another identical dynode (80), dynodes having a hyper-extended section which provides an overlap of about 0.1 mm when interleaved with another identical dynode (85), dynodes having a hyper-extended section which provides an overlap of about 1 mm when interleaved with another identical dynode (90), and prior art dynodes providing no overlap when opposed to another identical dynode (95).

The first set of dynodes (80) provide a moderate level tortuosity and therefore a moderate ability to exclude gas with contaminant, this being desirable given that this region of the multiplier is the entry point for any gas. A negative aspect is that a relatively moderate level of efficiency decrease is noted for electron amplification in this part of the multiplier.

The second set of dynodes comprises alternating dynodes (85) and (95) to provide a relatively low level of tortuosity and therefore a low ability to exclude gas with contaminant, this being desirable given that the previous dynodes (80) have already provided significant resistance to gas flow. The lower degree of overlap in this second set of dynodes provides for a relatively low negative effect on the efficiency of electron amplification.

The third set of dynodes (90) provide a relatively high tortuosity and therefore a relatively high ability to exclude gas with contaminant. This high ability is desirable given that this region of the multiplier has the highest levels of electron flux. The higher degree of overlap in this third set of dynodes provides for a relatively low negative effect on the efficiency of electron amplification.

The embodiments of FIGS. 4 through 10 demonstrate how the competing interests of a reduction in vacuum conductance and electron amplification efficiency may be balanced by the judicious use of different dynodes in different regions of the electron multiplier.

Each of the particular embodiments discussed up to this point have provided a physical baffle by way of a hyper-extension from a dynode. It will be understood however that the present invention is not so limited. It is to be understood that any teachings herein with regard to baffles formed by the hyper-extension of a section of a dynode apply to other forms of physical baffle that are not formed in this way. As will be clear, a baffle may be formed independently of a dynode and in such embodiments any of the teachings regarding baffles formed integrally with dynodes apply. The baffle may extend into a linear space of an electron multiplier from any structure in a prior art electron multiplier, or indeed from a structure specifically introduced into the design of an electron multiplier for the purpose of supporting a baffle.

Figure 11:
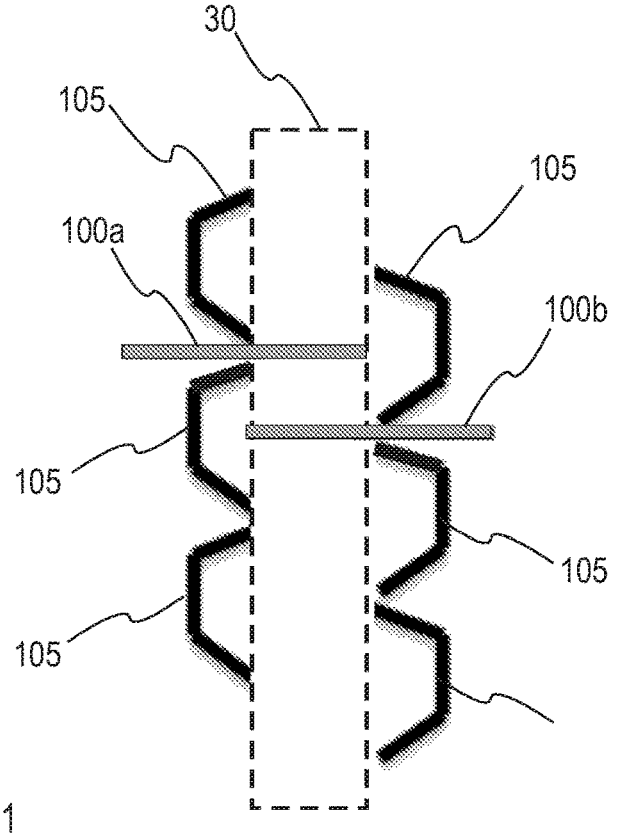
FIG. 11 and FIG. 12 each show a highly schematic diagram of dynodes of a partial electron multiplier whereby the baffles are separate to any dynode.

FIG. 11 shows an embodiment whereby two baffles (100*a*) and (100*b*) extend into the linear space (30), however the baffles (100*a*) and (100*b*) are not a part of, or physically attached to, any of the dynodes (105). It will be noted that the dynodes in this embodiment are prior art dynodes, without the blocking sections extended from the upper section often used in existing electron multipliers.

Figure 12:
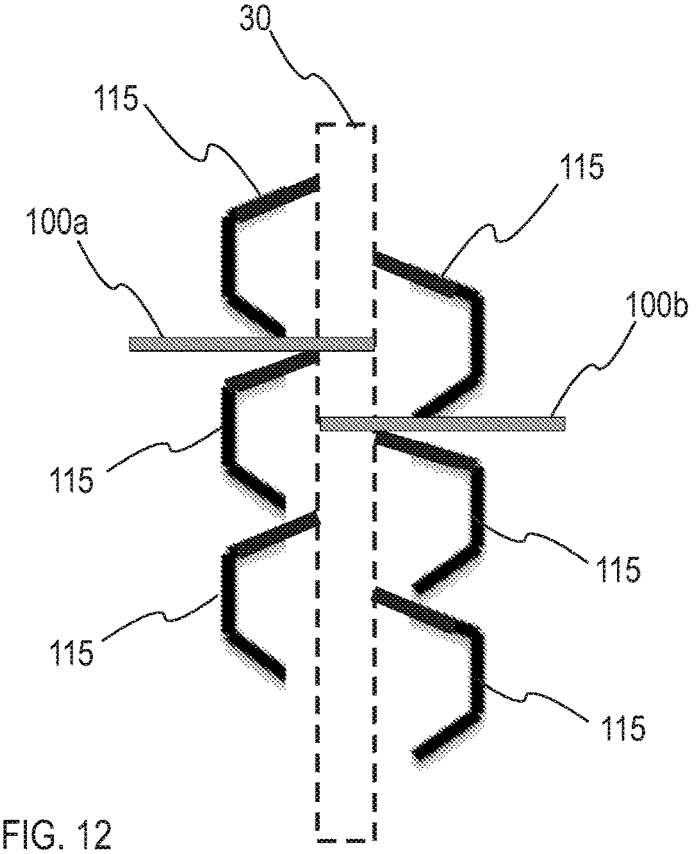

FIG. 12 shows an embodiment similar to that in FIG. 11, however comprising dynodes (115) having the extended blocking sections often used in prior art dynodes. In this embodiment, the baffles (110*a*) and (100*b*) are positioned so as to prevent collision with the extended blocking sections.

The embodiments of the drawings each show that a baffle extends into the linear space within the multiplier, but not beyond that space. In some circumstances, however, the terminus of a baffle may extend beyond the linear space.

The present electron multipliers will often be a part of a detector module. A detector comprises an electron multiplier in functional association with a collector/anode such that the avalanche of secondary electrons that are emitted from the terminal dynode impact on the collector/anode surface so as to generate an electrical signal. The magnitude of the signal is proportional to the number of electrons impacting on the surface, and is in turn representative of the original particle which triggered the secondary electron avalanche.

Figure 13:
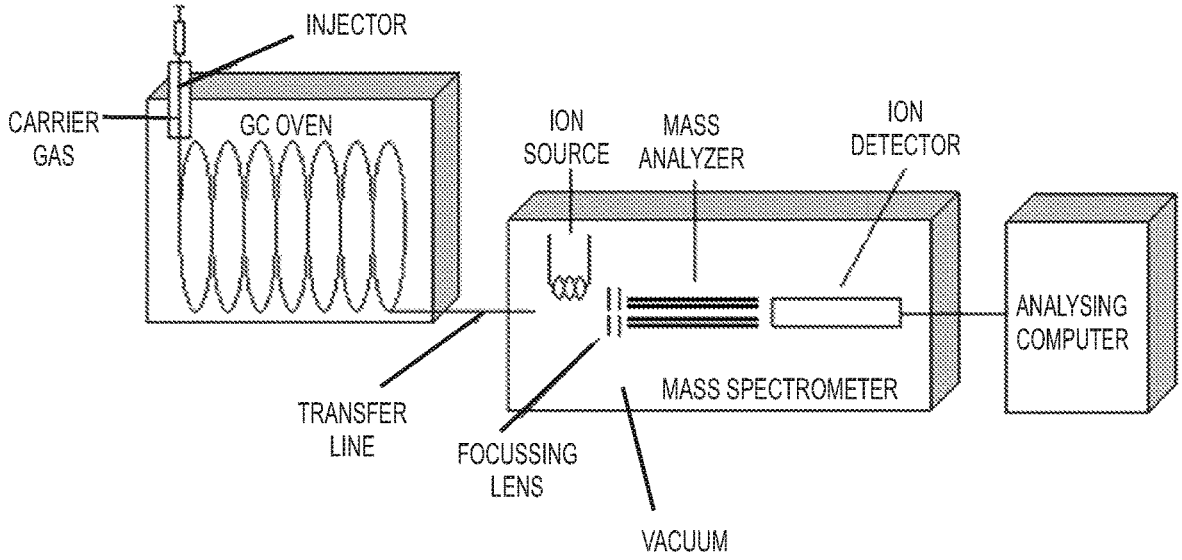
FIG. 13 (PRIOR ART)
FIG. 13 is a highly schematic block diagram showing a typical arrangement whereby a gas chromatography instrument is coupled to a mass spectrometer, the mass spectrometer having an ion detector configured to minimise vacuum conductance of the type as described herein.

Accordingly, in one aspect the present invention provides a detector comprising an electron multiplier as described herein. The detector may be an ion detector, and optionally of the type used in a mass spectrometer as an ion detector in accordance with the general prior art scheme shown in FIG. 13. FIG. 13 shows a typical arrangement of a gas chromatography instrument coupled to a mass spectrometer. Sample is injected and mixed with a carrier gas which propels the sample through the separation medium with the oven. The separated components of the sample exit the terminus of the transfer line and into the mass spectrometer. The components are ionized and accelerated through the ion trap mass analyser. Ions exiting the mass analyser enter the detector, with the signal for each ion being amplified by a discrete dynode electron multiplier therein (not shown). The amplified signals are processed with a connected computer.

Applicant has been the first to recognize that a detector is capable of defining its own internal environment that is distinct from the vacuum chamber environment. Accordingly, contaminants (from the carrier gas, or introduced via other portals such as pump seals and electrical feedthroughs) distributed within the chamber can migrate into the detector and spoil the detector internal environment. It has been further recognized that the presence of contaminants within the internal environment of a detector will have an acute negative effect on detector life, with the frequent repetition of contamination events leading to chronic decreases on detector life.

By the use of internal baffling, contaminant mobility within the detector may be reduced, thereby preserving the superior operating conditions self-generated by the detector. As discussed elsewhere herein, a detector may be further equipped with external shielding with the use of baffles acting in concert so as to (i) inhibit entry of a contaminant and (ii) inhibit mobility of a contaminant within a detector. Applicant has also been the first to recognize that this has acute negative effects (transiently altering the performance of the detector) but also more chronic negative effects which leads to long term performance deficient and a decrease in detector service life. Having discovered the true nature of the problem, Applicant provides a detector having one or more features which inhibit or prevent the entry of a contaminant by way of the internal baffling features described herein.

The detectors of the present invention may function so as to decrease the vacuum conductance of a gas or other material into and out of the detector. The present detectors may have the further effect of uncoupling the environment internal the detector from the environment external the detector. In any event, a desirable end result is a lessening of any opportunity for a potential contaminant to enter the detector and foul an electron emissive surface (such as a dynode surface) of an electron multiplier, or a collector/anode surface of the detector.

In some embodiments, the use of internal baffling is intended to be effective in respect of a carrier gas (such as hydrogen, helium or nitrogen) used to conduct sample to the ionization means of a mass spectrometer in which the detector is installed. Once the sample is ionized, the passage of the resulting ions is under control of the mass analyser, however residual carrier gas continues on beyond the mass analyser and toward the ion detector. In the prior art, no regard is had to the effect of the residual carrier gas on the service life and/or performance of the detector. Applicant has found that the residual carrier gas typically contains contaminants that foul or otherwise interfere with the operation of the dynodes (being the amplifying electron emissive surfaces) of the detector, or the collector/anode of the detector. In some circumstances, the carrier gas itself may have a deleterious effect on dynodes or a collector/anode.

Many embodiments of the present invention achieve advantage by controlling the vacuum conductance of a detector, which in turn controls coupling of the internal and external detector environments.

Where conductance is decreased in accordance with the present invention, the level of decrease may be expressed as a percentage of the conductance measured in the absence of a conductance-modulating feature of the present invention. The decrease in conductance may be greater than about 10%, 15%, 20%, 25%, 30%, 35%, 40%, 45%, 50%, 55%, 60%, 65%, 70%, 75%, 80%, 85%, 90%, 100%, 200%, 300%, 400%, 500%, 600%, 700%, 800%, 900% or 1000%.

The skilled artisan understands the concept of vacuum conductance, and is enabled to measure conductance of an electron multiplier or a detector, or at least the relative conductance of two detectors. As an approximation, a detector may be considered as a straight cylindrical pipe or a tube, the conductance of which may be is calculated by reference to the (overall) length (M) and radius (cm) of the pipe. The length is divided by the radius, which provides the L/a ratio, with the conductance (in L/sec, for example) being read off a reference table. The geometry of a detector may be somewhat different to a straight cylindrical pipe or a tube and so the absolute conductance calculated may not be accurate. However, for the purposes of assessing the effectiveness of a conductance-modulating feature of a detector, such approximations will be useful.

In reducing the detector vacuum conductance so as to minimise the coupling of the internal and external environments general improvement in detector internal environment may result. Without wishing to be limited by theory in any way, this approach may allow for the electron flux of an electron multiplier of a detector to act as a pump, thereby creating a cleaner environment for detector operation. This cleaner internal environment primarily extends the service life of the multiplier. The secondary benefits, depending on how the detector is operated, also include reduced noise, greater sensitivity, increased dynamic range and reduced ion feedback. Reduction in the detector's vacuum conductance limits the impact of a detrimental external environment on detector performance and life. This includes both sustained and acute effects.

A further advantage is in the minimisation the negative effects of detector operation on detector performance and life. Applicant has found that a user's choice of duty cycle, ion input current and mode has an effect on detector performance and to a large extent on detector longevity. Such effects arise due to the vacuum relaxation time, which is the time taken for a substantially perfect vacuum to form inside a detector to equalise with the external environment. Relaxation time is typically consistent with the 'off time' in a duty cycle.

Similarly, it has been demonstrated that the discretized nature of electric charge leads to pseudo off times at typical ion input currents. These pseudo off times can be of the order of the detector vacuum relaxation time at sufficiently low currents, especially when a detector is operated in a time-of-flight (TOF) mode. In TOF mode the analyte ions are collected together in time. The number of different analytes, and their mass distribution, therefore also determines the pseudo off times in TOF mode. By minimising a detector's vacuum conductance, the vacuum relaxation time of the detector is extended. This allows the detector to achieve its intended performance and life over a greater range of duty cycles and ion input currents. Extension of the vacuum relaxation time also limits the effect of detector operating mode and mixture of analyte ions on detector performance and life.

A further effect of reducing vacuum conductance is to minimise changes in detector calibration due to changes in the external detector environment. This includes both sudden losses in gain due to acute arrival of contaminants, as well as temporary gain recovery due to water molecules reaching the detector surfaces.

The present invention may be embodied in many forms, and having one or a combination of features which cause or assist in a decrease of vacuum conductance of a detector. The invention may be embodied in the form of: a sealed detector, a partially sealed detector; a detector with one or more gas flow barriers; a detector associated with appropriately designed off-axis input optics that shunts any gas flows present away from the detector; a detector comprising one or more gas flow barriers in association with appropriately designed off-axis input optics that shunts any gas flows present away from the detector; a detector comprising an engineered discontinuity such as a vent, a grill, an opening and/or an apertures to prevent a localised build-up of gas in a detector with a line-of-sight input aperture; a detector comprising one or more gas flow barriers that further comprise an engineered discontinuity such as a vent, a grill, an opening and/or an aperture to prevent a localised build-up of gas in a detector with a line-of-sight input aperture; a detector using adjustable (and preferably movable) gas flow barriers to minimise conductance during operation.

The use of internal baffling in an electron multiplier or detector may be combined with other means for reducing vacuum conductance. For example, Applicant has further discovered that altering the ability of gas and other materials (some of which may act as dynode contaminants and/or collector contaminants) to enter the detector via any interface or discontinuity of the detector under the vacuum established thereabout may affect service life and/or performance. The need to inhibit or prevent the entry of gas or other materials into and out of a detector by way of interfaces and discontinuities has not been previously considered by prior artisans when designing detectors for use in mass spectrometry and other applications.

Applicant proposes a range of features for incorporation into existing detector design, or alternatively as the bases for de novo detector design. These features have the common function of inhibiting or preventing the movement of an atom or a molecule or any larger species into the detector. In the absence of these features, such atoms, molecules or larger species would otherwise be capable of exploiting any discontinuity in a detector, or any interface between two detector elements to enter a detector and potentially contaminate an electron emissive surface or an anode/collector of the detector or cause other malfunction.

As understood by the skilled person, detectors are operated in various pressure regimes. At sufficiently low pressures, the gas inside and outside the detector no longer flows like a conventional fluid and instead operates in either transitional flow or molecular flow. Without wishing to be limited by theory in any way, Applicant proposes that when the internal and external detector environments are operating in transitional and/or molecular flow regimes (i.e. non-conventional flow), any interface between elements or a discontinuity in an element may provide a route via which a contaminant may enter the internal detector environment.

Given this discovery, there is proposed a solution in preventing or at least inhibiting the molecular or transitional flow of gas into the detector by various means. Such means include the use of a sealant composed of a material that is substantially gas impermeable and capable of forming a substantially gas-tight seal with detector elements. Other means include the implementation of various strategies for joining detector elements so as to provide a non-linear or tortuous path to limit or prevent the ability for gas into the detector.

As will be appreciated, any interface is in fact three dimensional, and accordingly many paths are available to a molecule traversing the interface even where a linear line of sight through the interface may be drawn. In the context of the invention, the term "non-linear or tortuous" is intended to include any arrangement whereby a linear line of sight cannot be drawn through the interface from one side to the other when a two dimensional cross-section is considered.

A means for preventing or at least inhibiting the molecular or transitional flow of gas into the detector may function as to absolutely prevent the passage of a gas molecule (or indeed any other contaminant) from external to internal the detector. In some forms of the invention, the means acts to delay or retard the passage of a gas molecule such that for a given time period, the number of molecules that enter the detector is less than that where no such means are provided.

The time period concerned may correspond (linearly or non-linearly) to a period between two episodes of analyte ion irradiation of a detector. For a current model mass spectrometer operating under typical conditions the time period will generally be in the second or millisecond range. In many circumstances the time period is about 1, 2, 3, 4, 5, 6, 7, 8, 9, 10, 20, 30, 40, 50, 60, 70, 80, 90, 100, 200, 300, 400, 500, 600, 700, 800, 900 or 1000 milliseconds.

Where a mass spectrometer is coupled to a separation apparatus (such as a gas chromatography apparatus), it may be desirable to inhibit or prevent entry of a sample carrier gas into the detector of the spectrometer for a period of at least about one hour, such period being required to pass the sample through the chromatography medium and to detect species sequentially exiting therefrom. Where a sample is directly injected into a mass spectrometer, the unit of time may be around 10 minutes, or even less.

To decrease the coupling of the external and internal detector environments the features described infra with regard to the limitation in gas flow via a detector housing interface or discontinuity are contemplated to be useful. For example, where the detector is incorporated in a mass spectrometer the decoupling enables the detector itself to act as a pump. By sealing/shielding the detector, this internal pumping mechanism creates a beneficial environment. Little or no internal pumping occurs without the sealing/shielding because it is a relatively weak pump. This internal pumping acts additively to the vacuum pump of a mass spectrometer to create a superior operating environment in which the electron emissive surfaces or an anode/collector surface may operate. The primary benefit of a better operating environment is increased detector operating life. Secondary benefits include reduced noise, reduced ion feedback, increased sensitivity and increased dynamic range.

A detector may comprise a unitary element having a discontinuity therein. The element may be dedicated to or incidentally responsible for maintaining separation between an internal detector environment (i.e. the environment about the electron emissive surfaces or a collector/anode surface) and an external detector environment (i.e. the environment within a vacuum chamber in which the detector is operable). The separation in environments provided by the unitary element does not necessarily provide complete separation and in many instances may only lessen the probability that a gas molecule will enter the environment internal the detector.

The discontinuity in the unitary detector element may be a discrete aperture for example, that allows for molecular or transitional flow of gas into the detector. Alternatively, the discontinuity may arise from a porousness of a material from which the detector element is fabricated which allows for molecular or transitional flow of gas through the material and into the detector. In any event, a sealant may be applied to the discontinuity so as to provide a barrier or partial barrier to passage of the gas or any other contaminant comingling therewith.

The sealant may have adhesive properties also to facilitate bonding to the surface of a discontinuity, and also surrounding material so as to prevent dislodgement in the course of a vacuum being formed and broken as is routine in the vacuum chamber of a mass spectrometer.

Suitable sealants/adhesives may include a solder, a polymer such as a polyimide (optionally in tape form, such as Kapton™ tape). Preferably the sealant/adhesive is one that, once cured, minimally contributes to "virtual leak" in that it does not substantially desorb a liquid, a vapour or a gas into the chamber under vacuum. Such materials are often termed in the art "vacuum safe".

In some circumstances, the construction of a detector requires the association of two or more elements, to provide a composite structure. The composite structure may be dedicated to or incidentally responsible for maintaining separation between an internal detector environment (i.e. the environment about the electron emissive surfaces or a collector/anode surface) and an external detector environment (i.e. the environment within a vacuum chamber in which the detector is operable).

The composite structure may provide a means for preventing or at least inhibiting the molecular or transitional flow of gas into the detector, and in which case an interface between two detector elements provides a potential means by which a gas may enter into the detector by way of molecular or transitional flow.

Either or both detector elements contributing to the composite structure may be configured in a dedicated or incidental manner to achieve the aim of preventing or at least inhibiting the molecular or transitional flow of gas into the detector. These features may be incorporated into the detector alone, or in combination with any one or more of any other feature of disclosed herein.

In other embodiments, a third element may be added to the composite structure to further prevent or at least inhibit the molecular or transitional flow of gas into the detector. For example, where a first and second element abut to form an interface a third element may be applied over the first and second elements so as to straddle the interface. The third element may be secured in place by any means, but preferably by way of an adhesive, and more preferably an adhesive with sealant properties. Any one or more of these features may be incorporated into the detector alone, or in combination with any one or more of any other feature of disclosed herein.

Figure 14:
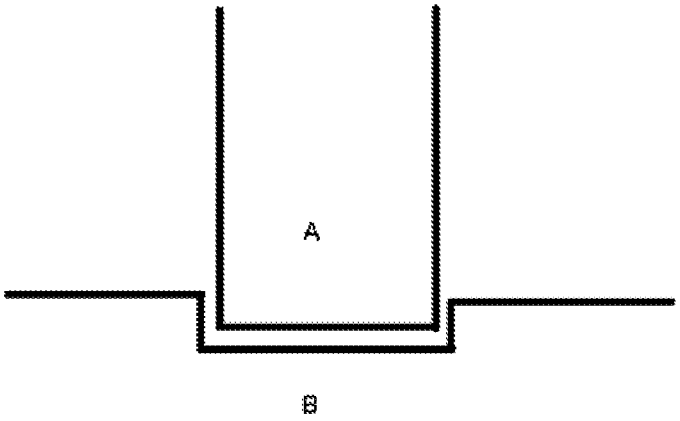
FIG. 14 is a cross-sectional diagram of an exemplary interface between two detector elements ("A" and "B") so as to form a non-linear or tortuous path at the interface thereof.

Reference is made to FIG. 14, which shows a first detector element "A" and second detector element "B", detector element "B" having a recess that allows for element "A" to snugly fit therein. The elements "A" and "B" are shown separated so as to more clearly show the profile of each and also the "U"-shaped interface between the two elements. In reality, the elements "A" and "B" would be mutual contact so as to form an interface providing a barrier or partial barrier to a gas.

Even though the elements "A" and "B" contact each other, a gas may nevertheless pass via the interface by molecular or transitional flow so as to move from an environment external the detector to an environment internal the detector. However, the non-linear or tortuous path provided by the two 90 degree corners of the interface inhibits the transitional or molecular flow of gas therethrough. Any one or more of these features may be incorporated into the detector alone, or in combination with any one or more of any other feature of disclosed herein.

The arrangement of FIG. 14 is in contrast to a situation where element "B" has no recess, and element "A" merely sits on the planar surface of element "B". In that situation, the interface is strictly linear, and accordingly a gas is more likely to migrate by molecular or transitional flow from external to internal the detector as compared with the arrangement of FIG. 14 where the interface defines a non-linear or tortuous path. Any one or more of these features may be incorporated into the detector alone, or in combination with any one or more of any other feature of disclosed herein.

Figure 15:
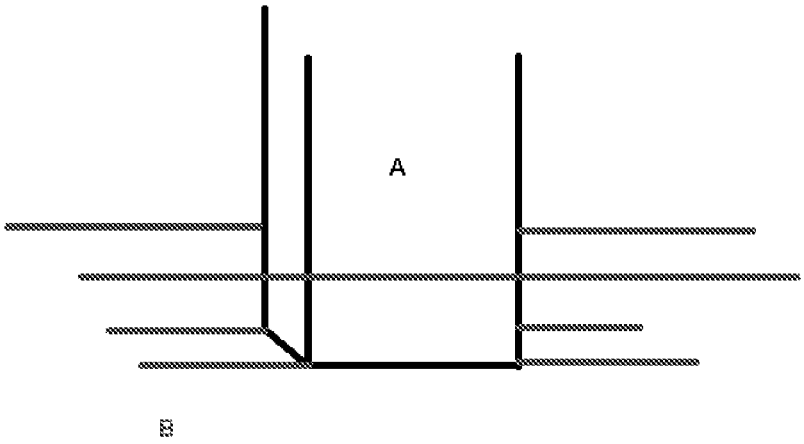
FIG. 15 is a perspective diagram of an exemplary interface between two detector elements ("A" and "B") so as to form a non-linear or tortuous path at the interface thereof.

FIG. 15 shows a similar arrangement to that in FIG. 14 except that a relatively deep longitudinal slot is provided in element "B" into which element "A" is snugly engaged. The interface formed between elements "A" and "B" of FIG. 15 is longer than that formed than that shown in FIG. 14 given the increased depth of the slot in element "B". The further length minimises the ability for a gas molecule to migrate the length of the interface in a unit time. These features may be incorporated into the detector alone, or in combination with any one or more of any other feature of disclosed herein.

Figure 16:
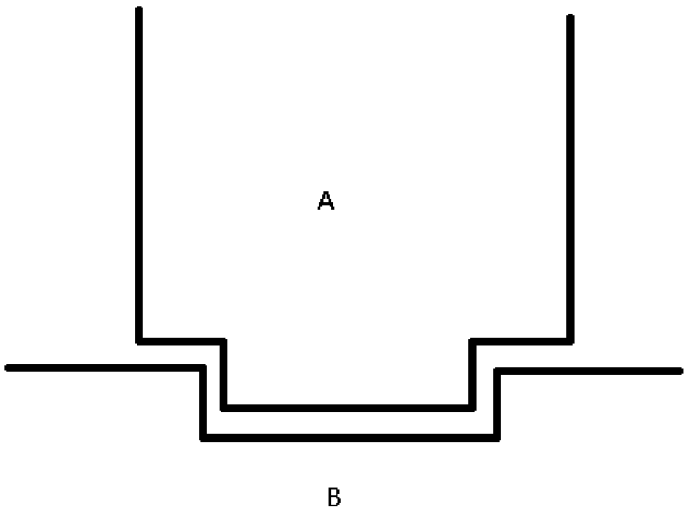
FIG. 16 is a cross-sectional diagram of an exemplary interface between two detector elements ("A" and "B") so as to form a non-linear or tortuous path at the interface thereof, one of the elements having a formation and the other having a complimentary recess.

FIG. 16 shows an interface formed by element "A" and element "B", similar to the embodiment of FIG. 14 with element "A" having a downwardly extending formation configured so as to snugly engage with the recess formed in element "B". This arrangement provides an improved barrier or partial barrier to the migration of gas by molecular or transitional flow over the embodiment of FIG. 14. The improvement results from the elongation of the path defined by interface, and also the non-linear or tortuous path having four 90 degree corners. These features may be incorporated into the detector alone, or in combination with any one or more of any other feature of disclosed herein.

Figure 17:
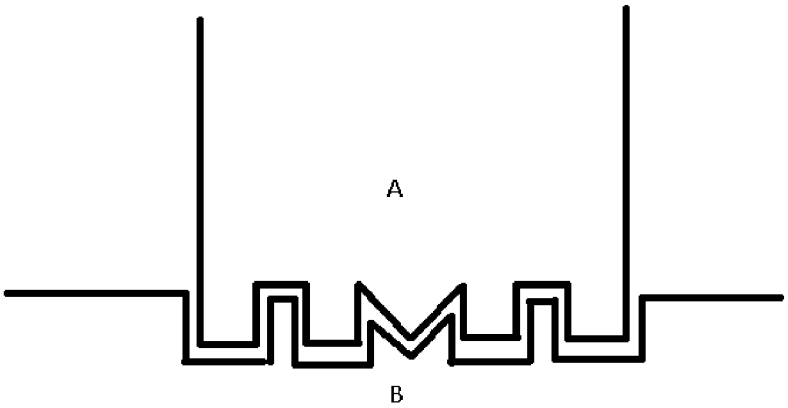
FIG. 17 is a cross-sectional diagram of an exemplary interface between two detector elements ("A" and "B") so as to form a non-linear or tortuous path at the interface thereof, one of the elements having a series of formations and the other having a series of complimentary recesses.

FIG. 17 shows an interface formed by element "A" and element "B", similar to the embodiment of FIG. 16 however with element "A" having a series of downwardly extending formations configured so as to snugly engage with a complimentary recess of element "B". This arrangement provides an improved barrier or partial barrier to the migration of gas by molecular or transitional flow over the embodiment of FIG. 16. The improvement results from the elongation of the path defined by interface (each of the formations extended the path length), and also the non-linear or tortuous path having ten 90 degree corners and three 45 degree corners. These features may be incorporated into the detector alone, or in combination with any one or more of any other feature of disclosed herein.

Figure 18:
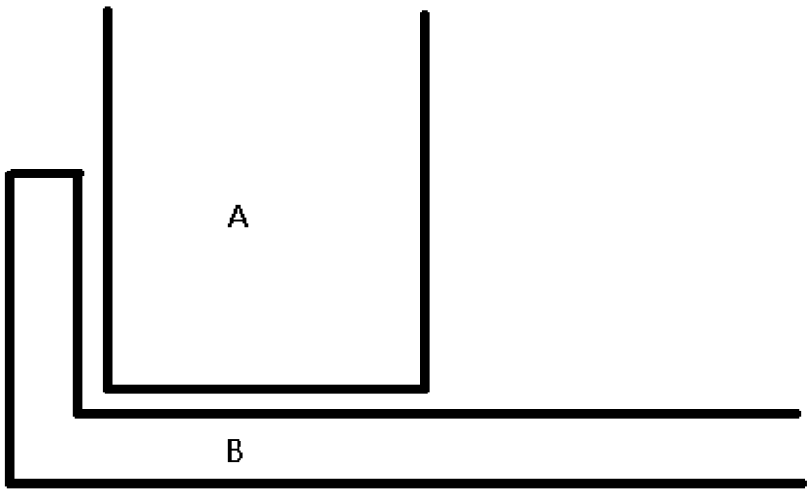
FIG. 18 is a cross-sectional diagram of an exemplary interface between two detector elements ("A" and "B") so as to form a non-linear or tortuous path at the interface thereof, one of the elements having a peripheral lip.

FIG. 18 shows an embodiment whereby element "B" comprises a lip against which element "A" abuts on its lateral face. The downwardly directed end face of element "A" contacts the upwardly facing surface of element "B". In this arrangement, the interface provides a non-linear or tortuous path having a single 90 degree corner. As will be appreciated, the depth of lip adds to the path length with a deeper lip providing increased inhibition or prevention of molecular or transitional flow of gas along the interface. These features may be incorporated into the detector alone, or in combination with any one or more of any other feature of disclosed herein.

Figure 19:
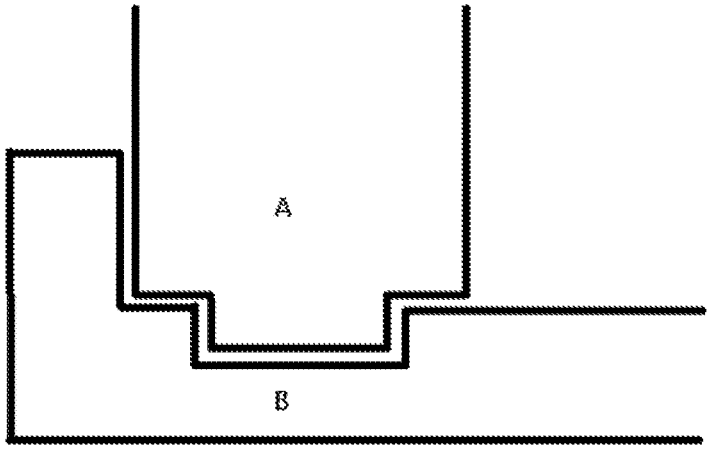
FIG. 19 is a cross-sectional diagram of an exemplary interface between two detector elements ("A" and "B") so as to form a non-linear or tortuous path at the interface thereof, one of the elements having a peripheral lip and a recess and the other having a complementary formation.

FIG. 19 shows a more complicated arrangement including the use of a formation on element "A", with a complementary recess and a lip on element "B". It will be appreciated that the thickness of element "A" (in the y-direction) provides an increased path length to more effectively inhibit passage of gas through the interface.

It will be appreciated that a non-linear or tortuous path may be comprised at least in part of curved segment, or multiple curved segments. For example, in reference to FIG. 14, the downwardly facing surface of element "A" may be curved or rippled, with the recess of element "B" being complimentary such that the two elements fit together snugly. Generally, the use of shallow curves may be less effective than 90 degree corners in preventing or inhibiting the migration of gas through the interface based on molecular or transitional flow.

In some embodiments a non-linear or tortuous path is provided by a combination of curved and linear segments.

In any of the embodiments above, and any further embodiments conceived by the skilled person a sealant (that may also function as an adhesive) may be applied to mutually contacting region(s) of element "A" and/or element "B" before assembly in order to further limit any gas flow through the interface. In addition or alternatively, the sealant/adhesive may be disposed outside of the interface so as to cover any region where element "A" and element "B"

abut (for example, along a line formed by a laterally facing surface of element "A" and an upwardly facing surface of element "B"). These features may be incorporated into the detector alone, or in combination with any one or more of any other feature of disclosed herein.

A sealant may be used within or about the interface of two elements, where the two elements provide a linear or non-tortuous path from the environment external the detector to an environment internal the detector. Even though a linear or non-tortuous path is provided, the presence of a seal may be sufficient in some circumstances to adequately inhibit or prevent the entry of gas molecules into the detector.

The present detector may be used in any application deemed suitable by the skilled person. A typical application will be as an ion detector in a mass spectrometer.

Given the discovery by the Applicant of the advantages of uncoupling the internal detector environment from the external detector environment, it is proposed that developments in detector construction will include the provision of more complete enclosures and housings so as to protect the electron emissive surfaces or a collector/anode surface from contaminants inherently present in vacuum chamber. Thus, various housing or enclosure elements may be added to prior art detectors and in that regard interfaces between elements may be created.

In addition to the configuration of detector element interfaces as described above, further structural features may be incorporated into a detector. As a first feature, the external surface of the detector enclosure may consist of as few continuous pieces (elements) as possible. Preferably, the enclosure is fabricated from a single piece of material so as to provide a continuous external surface, and in that case any discontinuities may be sealed with a sealant. This feature may be incorporated into the detector alone, or in combination with any one or more of any other feature of disclosed herein.

The size of any engineered discontinuity in the detector enclosure may be dimensioned so as to be as small (in terms of area) as possible. As used in this context, the term "engineered discontinuity" is intended to include any means by which a gas may migrate from external to internal the detector, such as any aperture, grating, grill, vent, opening or slot that is deliberately engineered into the detector. Such discontinuities will typically have a function (such as the admission of an ion stream into the detector), and accordingly may be dimensioned to be just large enough to perform the required function, but preferably no larger. In some embodiments, the engineered discontinuity may be larger than the absolute minimum required for proper functioning but may not be more than 1%, 2%, 3%, 4%, 5%, 6%, 7%, 8%, 9%, 10%, 11%, 12%, 13%, 14%, 15%, 16%, 17%, 18%, 19% or 20% larger than the absolute minimum required size. This feature may be incorporated into the detector alone, or in combination with any one or more of any other feature of disclosed herein.

Any engineered discontinuity in the detector enclosure may be oriented or aligned or otherwise spatially arranged to face away from any gas flowing in the external environment of the detector, such as a flow of residual carrier gas present in the mass spectrometer. This feature may be incorporated into the detector alone, or in combination with any one or more of any other feature of disclosed herein.

The external surface of the detector enclosure may use rounded features to create laminar flows and/or vortices from any gas flowing about the environment external to the detector. These laminar flows and/or vortices may provide high gas pressure regions that effectively seal a discontinuity which would other admit residual carrier gas. This feature may be incorporated into the detector alone, or in combination with any one or more of any other feature of disclosed herein.

Any discontinuity in the detector enclosure surface may have an associated gas flow barrier to inhibit the entry of a residual carrier gas. In some embodiment, the gas flow barrier is a detector element part of which may form an interface with another detector element. As will be appreciated, while a gas flow barrier may provide advantage, such a barrier may provide also a further portal for the entry of gas into the detector where the barrier forms an interface with another element of the detector. Given the benefit of the present specification, the skilled person is enabled to conceive of a range of contrivances that would be suitable for that function.

In some embodiments, the barrier has first and second openings, with one of the openings in gaseous communication with a discontinuity in the detector enclosure (and therefore the environment interior the detector) and the second opening in gaseous communication with environment exterior the detector. The second opening may be distal to the detector so as to be substantially clear of any flow of gas (such as a residual carrier gas). Any one or more of these features may be incorporated into the detector alone, or in combination with any one or more of any other feature of disclosed herein.

In some embodiments, the second opening is still exposed to a flow of gas, however the barrier is configured to prevent or inhibit the entry of the flowing gas to the interior environment of the detector. This end may be achieved by inhibiting or preventing the flow of gas that has entered the barrier, such that less or no gas that has entered flows to the environment internal the detector. For example, a gas flow barrier may be as long as possible, and/or as narrow as possible, and/or comprise one or more bends or corners; and/or comprise one or more 90 degree bends, and/or comprises internal baffling to minimise internal lines-of-sight. Any one or more of these features may be incorporated into the detector alone, or in combination with any one or more of any other feature of disclosed herein.

A gas flow barrier may be configured or positioned or orientated such that any opening faces away from a gas flows in the environment external the detector such as a flow of residual carrier gas used by a mass spectrometer. This feature may be incorporated into the detector alone, or in combination with any one or more of any other feature of disclosed herein.

A gas flow barrier may comprise rounded exterior surfaces so as to prevent or inhibit any electric discharge. Such rounded surfaces may, in addition or alternatively, create laminar gas flows and/or vortices from a gas flowing in the environment external the detector. These laminar flows and/or vortices may provide high pressure regions that essentially seal off an opening of the shield. This feature may be incorporated into the detector alone, or in combination with any one or more of any other feature of disclosed herein.

Two or more gas flow barriers may be configured or positioned or orientated so as to work together additively or synergistically so as to prevent or inhibit the entry of a gas flowing external the detector into the internal environment of the detector. This feature may be incorporated into the detector alone, or in combination with any one or more of any other feature of disclosed herein.

As a further feature the detector may comprise internal baffling to limit or completely remove any or all internal lines-of-sight through the detector. This feature is generally applicable so long as the optics of particles (such as ions and electrons) are not negatively impacted. This feature may be incorporated into the detector alone, or in combination with any one or more of any other feature of disclosed herein.

A detector will typically comprise an input aperture to admit a particle beam. Applicant has found that such aperture will typically admit significant amounts of residual carrier gas and associated material and in effect couples the detector interior and exterior environments. As discussed elsewhere herein such coupling is undesirable in many circumstances, and accordingly to the extent possible the size of the input aperture should be minimised This feature may be incorporated into the detector alone, or in combination with any one or more of any other feature of disclosed herein.

Where a detector comprises two apertures, it is preferred that the apertures are arranged such that there is no total or partial direct line-of-sight between the apertures. Such arrangement acts to interfere with the free flow of gas through the detector, this in turn preventing or inhibit entry of the residual carrier gas into the detector. This feature may be incorporated into the detector alone, or in combination with any one or more of any other feature of disclosed herein.

While the present invention has been described primarily by reference to a detector of the type used in a mass spectrometer, it is to be appreciated that the invention is not so limited. In other applications the particle to be detected may not be an ion, and may be a neutral atom, a neutral molecule, or an electron. In any event, a detector surface is still provided upon which the particles impact.

Those skilled in the art will appreciate that the invention described herein is susceptible to further variations and modifications other than those specifically described. It is understood that the invention comprises all such variations and modifications which fall within the spirit and scope of the present invention.

While the invention has been disclosed in connection with the preferred embodiments shown and described in detail, various modifications and improvements thereon will become readily apparent to those skilled in the art.

Accordingly, the spirit and scope of the present invention is not to be limited by the foregoing examples, but is to be understood in the broadest sense allowable by law.

The invention claimed is:

1. An electron multiplier comprising:

a series of discrete electron emissive surfaces configured to provide an electron amplification chain; and one or more baffles configured to inhibit or prevent a contaminant from entering into, or passing partially through, or passing completely through the electron multiplier, wherein at least one of the one or more baffles is:

(i) formed by a hyper-extended section of one of the series of discrete electron emissive surfaces, or (ii) formed independently of the electron emissive surfaces.

2. The electron multiplier of claim 1 comprising at least about 2, 3, 4, 5, 6, 7, 8, 9, 10, 11, 12, 13, 14, 15, 16, 17, 18, 19 or 20 baffles.

3. The electron multiplier of claim 1, wherein the one or more baffles are configured so as to decrease vacuum conductance of the electron multiplier compared to the same or similar electron multiplier not having one or more baffles.

4. The electron multiplier of claim 1, wherein the electron multiplier has an axis and an input and an output, and a linear path is defined within the electron multiplier from the input to the output, the linear path being coincident with or parallel to the axis, the linear path allowing for a contaminant to enter into, or pass partially through, or pass completely through the electron multiplier but for the presence of the one or more baffles.

5. The electron multiplier of claim 1, wherein the series of discrete electron emissive surfaces are disposed about a central axis of the electron multiplier, and wherein the one or more baffles approach, abut or intersect with the central axis.

6. The electron multiplier of claim 1, wherein the series of discrete electron emissive surfaces are disposed about a central axial region of the electron multiplier, and wherein the one or more baffles extend into the central axial region.

7. The electron multiplier of claim 6, wherein the one or more baffles completely traverse the central axial region.

8. The electron multiplier of claim 7, further comprising a baffle support structure, wherein the baffle support structure is (i) dedicated to function as a baffle support, or (ii) is not dedicated to function as a baffle support and in which case is a housing of the electron multiplier or any other structure of the electron multiplier.

9. The electron multiplier of claim 1, wherein:

at least one of the series of discrete electron emissive surfaces is a dynode, at least one of the one or more baffles is formed by a hyper-extended section of one of the series of discrete electron emissive surfaces, and the hyper-extended section extends from the dynode.

10. The electron multiplier of claim 9, wherein the dynode has a peripheral region and the hyper-extended section extends from the peripheral region.

11. The electron multiplier of claim 9, wherein the dynode has, in cross-section, a first section and a third section each of which extend generally toward a central axis or central region of the electron multiplier, the first and third sections being joined by a second section, and wherein (i) the baffle that is formed by the hyper-extended section extends from the first section or the third section, or (ii) the first section or the third section are extended so as to function in least in part as the baffle.

12. The electron multiplier of claim 11, wherein the first section is, in cross-section, longer than the third section.

13. The electron multiplier of claim 12, wherein the second section has a length, in cross-section, that is intermediate to a length of the first section and the second section.

14. The electron multiplier of claim 12, wherein each of the series of discrete electron emissive surfaces is a dynode, the series of dynodes being arranged in an interleaving manner, and wherein the first section of the dynode interleaves with the first section of the next dynode in the amplification chain.

15. The electron multiplier of claim 14, wherein the first section of the dynode is the section most proximal to electron multiplier input.

16. The electron multiplier of claim 15, wherein the first section of a dynode interleaves with the first section of the next dynode in the amplification chain so as to provide overlapping between the first and second sections of at least about 0.1 mm, 0.2 mm, 0.3 mm, 0.4 m, 0.5 mm, 0.6 mm, 0.7 mm, 0.8 mm, 0.9 mm, 1.0 mm, 1.1 mm, 1.2 mm, 1.3 mm, 1.4 mm, 1.5 mm, 1.6 mm, 1.7 mm, 1.8 mm, 1.9 mm, or 2.0 mm.

17. The electron multiplier of claim 9, wherein the dynode is fabricated from a single piece of material, and the first and third sections of the dynode are each defined by a bend at a respective interface with the second section, and wherein the first and third sections extend generally toward a central axis or a central region of the electron multiplier.

18. The electron multiplier of claim 9, wherein each of the series of discrete electron emissive surfaces is a dynode, the series of dynodes being arranged in an interleaving manner.

19. The electron multiplier of claim 9, wherein at least one of the at least one dynode is configured or positioned to function as a baffle.

20. The electron multiplier of claim 1, wherein at least one of the one or more baffles each extend for a distance of about 0.1 mm, 0.2 mm, 0.3 mm, 0.4 m, 0.5 mm, 0.6 mm, 0.7 mm, 0.8 mm, 0.9 mm, 1.0 mm, 1.1 mm, 1.2 mm, 1.3 mm, 1.4 mm, 1.5 mm, 1.6 mm, 1.7 mm, 1.8 mm, 1.9 mm, or 2.0 mm.

21. An electron multiplier comprising:

a series of discrete electron emissive surfaces configured to provide an electron amplification chain; and one or more baffles configured to prevent or inhibit a contaminant from entering into, or passing partially through, or passing completely through the electron multiplier, and wherein each of the series of discrete electron emissive surfaces is a dynode, and at least one of the one or more baffles extends from at least one of the dynodes, and wherein the at least one dynode has a peripheral region and the at least one baffle extends from the peripheral region.

22. An electron multiplier comprising:

a series of discrete electron emissive surfaces configured to provide an electron amplification chain; and one or more baffles configured to prevent or inhibit a contaminant from entering into, or passing partially through, or passing completely through the electron multiplier, and wherein each of the series of discrete electron emissive surfaces is a dynode, and at least one of the one or more baffles extends from at least one of the dynodes, the series of dynodes being arranged in an interleaving manner.

23. An electron multiplier comprising:

a series of discrete electron emissive surfaces configured to provide an electron amplification chain; and one or more baffles configured to prevent or inhibit a contaminant from entering into, or passing partially through, or passing completely through the electron multiplier, and wherein each of the series of discrete electron emissive surfaces is a dynode, and at least one of the one or more baffles extends from at least one of the dynodes, and wherein each dynode has, in cross-section, a first section and a third section each of which extend generally toward a central axis or central region of the electron multiplier, the first and third sections being joined by a second section, and wherein (i) the at least one baffle extends from the first section or the third section, or (ii) the first section or the third section are extended so as to function in least in part as the at least one baffle, and wherein the first section is, in cross-section, longer than the third section.

24. The electron multiplier of claim 23, wherein the first section of each dynode is the section most proximal to electron multiplier input.

25. The electron multiplier of claim 24, wherein the first section of each dynode interleaves with the first section of the next dynode in the amplification chain to overlap between the first and second sections of at least about 0.1 mm, 0.2 mm, 0.3 mm, 0.4 m, 0.5 mm, 0.6 mm, 0.7 mm, 0.8 mm, 0.9 mm, 1.0 mm, 1.1 mm, 1.2 mm, 1.3 mm, 1.4 mm, 1.5 mm, 1.6 mm, 1.7 mm, 1.8 mm, 1.9 mm, or 2.0 mm.

* * * * *